US008181415B2

(12) United States Patent
Mancine

(10) Patent No.: US 8,181,415 B2
(45) Date of Patent: May 22, 2012

(54) MODULAR CONSTRUCTION BLOCK

(76) Inventor: Steven J. Mancine, Livermore, ME (US)

( * ) Notice: Subject to any disclaimer, the term of this patent is extended or adjusted under 35 U.S.C. 154(b) by 367 days.

(21) Appl. No.: 12/588,549

(22) Filed: Oct. 19, 2009

(65) Prior Publication Data

US 2010/0101170 A1 Apr. 29, 2010

Related U.S. Application Data

(60) Provisional application No. 61/193,057, filed on Oct. 24, 2008.

(51) Int. Cl.
*E04B 1/02* (2006.01)

(52) U.S. Cl. ..... 52/570; 52/380; 52/474; 52/479; 52/483.1; 52/564

(58) Field of Classification Search ..... 52/380, 52/474, 479, 483.1, 503, 561, 564, 570, 596, 52/606, 607, 598, 649.1; 446/117, 124
See application file for complete search history.

(56) References Cited

U.S. PATENT DOCUMENTS

| | | | | |
|---|---|---|---|---|
| 3,668,832 | A | 6/1972 | Harman | |
| 4,263,765 | A | 4/1981 | Maloney | |
| 4,439,967 | A | 4/1984 | Dielenberg | |
| 4,894,969 | A | 1/1990 | Horobin | |
| 5,014,480 | A | 5/1991 | Guarriello et al. | |
| 5,086,600 | A | 2/1992 | Holland et al. | |
| 5,123,222 | A | 6/1992 | Guarriello et al. | |
| 5,291,711 | A * | 3/1994 | Kopaz | 52/503 |
| 5,311,718 | A | 5/1994 | Trousilek | |
| 5,473,850 | A | 12/1995 | Balding | |
| 5,566,521 | A | 10/1996 | Andrews et al. | |
| 5,570,552 | A | 11/1996 | Nehring | |
| 5,596,855 | A | 1/1997 | Batch | |
| 5,699,640 | A | 12/1997 | Bourgeois et al. | |
| 6,122,880 | A * | 9/2000 | Kolb et al. | 52/592.6 |
| 6,167,669 | B1 * | 1/2001 | Lanc | 52/426 |
| 7,044,825 | B2 * | 5/2006 | Glickman et al. | 446/121 |

* cited by examiner

*Primary Examiner* — William Gilbert
*Assistant Examiner* — Patrick Maestri
(74) *Attorney, Agent, or Firm* — Richard C. Litman

(57) ABSTRACT

The modular construction block is a modular construction element for forming structures such as earth retaining walls, for example. A plurality of modular construction blocks are provided for the formation of the desired structures, with each block being hollow so as to fill the structure with concrete. Rather than acting as a removable form for the construction of a concrete wall, for example, the blocks are left in place, forming part of the permanent structure. Each modular construction block includes a hollow parallelepiped frame having first and second laterally opposed walls secured to a pair of laterally opposed ends of the hollow frame. The upper end, the lower end and a pair of longitudinally opposed ends of the hollow frame all remain open for receiving poured concrete. Both horizontally and vertically adjacent ones of the blocks are secured to one another to form the structure.

6 Claims, 8 Drawing Sheets

MODULAR CONSTRUCTION BLOCK

CROSS-REFERENCE TO RELATED APPLICATION

This application claims the benefit of U.S. Provisional Patent Application Ser. No. 61/193,057, filed Oct. 24, 2008.

BACKGROUND OF THE INVENTION

1. Field of the Invention

The present invention relates to modular construction elements. Particularly, the inventive modular construction block is a modular construction element for forming structures such as earth retaining walls, sound walls, property boundary dividers, foundations, and the like, for example. More particularly, a plurality of interlocking modular construction blocks are provided for the formation of the desired structures, with each block being hollow so as to fill the structure with concrete.

2. Description of the Related Art

The construction of concrete structures, such as retaining walls, typically involves the use of removable forms that receive uncured concrete. Alternatively, a plurality of cement blocks may be laid and mortared together, in brick-like fashion. These techniques, however, require a great deal of professional skill and, often, the usage of heavy equipment.

When forming a wall using concrete forms, the wall is typically formed by assembling a series of braced wood or metal walls in the desired shape of the finished wall. Once the concrete has been poured into the forms and cured, the forms are removed, cleaned, and repaired prior to transporting them away from the construction site. This construction method requires the use of skilled workers to assemble to forms properly, to pour the concrete, and then to disassemble the forms. Further, the method is costly in terms of the time consumed to set-up and then dispose of the concrete forms. Adding to the overall costs are the expenses, in terms of time, labor and money, of transportation and storage of the forms.

The form sections are typically made of wood or metal, thus making them too heavy to be lifted by hand, often requiring the use of a forklift or crane to place them and then later remove them. Additionally, once the forms have been removed, the concrete is then exposed directly to the elements. Further, the exposed concrete is susceptible to cracking, which can cause water and air leaks into the structure.

Cement block construction methods present problems similar to concrete forms, and further have their own unique disadvantages. The blocks are stacked like bricks and then mortared together in order to form the wall. The mortar joints are susceptible to cracking, thus making the structure vulnerable to air and water intrusion, as in the above-described form-based construction method. Additionally, the structural strength of a cement block structure is significantly less than that of an all-concrete equivalent due to the relatively weak mortar joints.

Further, cement blocks are relatively bulky and heavy, thus requiring a great deal of labor and expense to transport the blocks and then stack them. As an added disadvantage, once construction begins, the shape of the structure cannot be rearranged without demolishing the already laid and mortared blocks. But, little flexibility exists in this construction method.

Thus, a modular construction block solving the aforementioned problems is desired.

SUMMARY OF THE INVENTION

The modular construction block is a modular construction element for forming structures such as earth retaining walls, for example. A plurality of such interlocking modular construction blocks are provided for the formation of the desired structures, with each block being hollow so as to fill the structure with concrete. Rather than acting as a removable form for the construction of a concrete wall, for example, the blocks are left in place, forming part of the permanent structure.

Each modular construction block includes a hollow frame having a pair of upper longitudinally extending members, a pair of lower longitudinally extending members, a pair of upper laterally extending members respectively secured to, and extending between, longitudinally opposed ends of the pair of upper longitudinally extending members, a pair of lower laterally extending members respectively secured to, and extending between, longitudinally opposed ends of the pair of lower longitudinally extending members, and first and second pairs of vertically extending members respectively secured to, and extending between, vertically adjacent ends of the pairs of upper and lower longitudinally extending members. The modular construction block is preferably a parallelepiped.

First and second walls are secured to, and cover, laterally opposed ends of the hollow frame. When stacked together, the first and second walls of multiple modular construction blocks form the outer walls of the retaining wall, with concrete being poured within the hollow interiors.

Further, a plurality of projecting engaging elements are formed on upper surfaces of the pair of upper longitudinally extending members, and a plurality of recesses are formed in lower surfaces of the pair of lower longitudinally extending members. In use, the plurality of projecting engaging elements are received within the plurality of recesses of a vertically adjacent one of the modular constructions blocks.

Similarly, a pair of vertically extending engaging bars are mounted to the first pair of vertically extending members, and a pair of vertically extending recesses are formed in the second pair of vertically extending members. In use, the pair of vertically extending engaging bars are received within the pair of vertically extending recesses of a horizontally adjacent one of the modular construction blocks. Both horizontally and vertically adjacent ones of the blocks are secured to one another to form the structure, without the need of additional fasteners or accessories.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
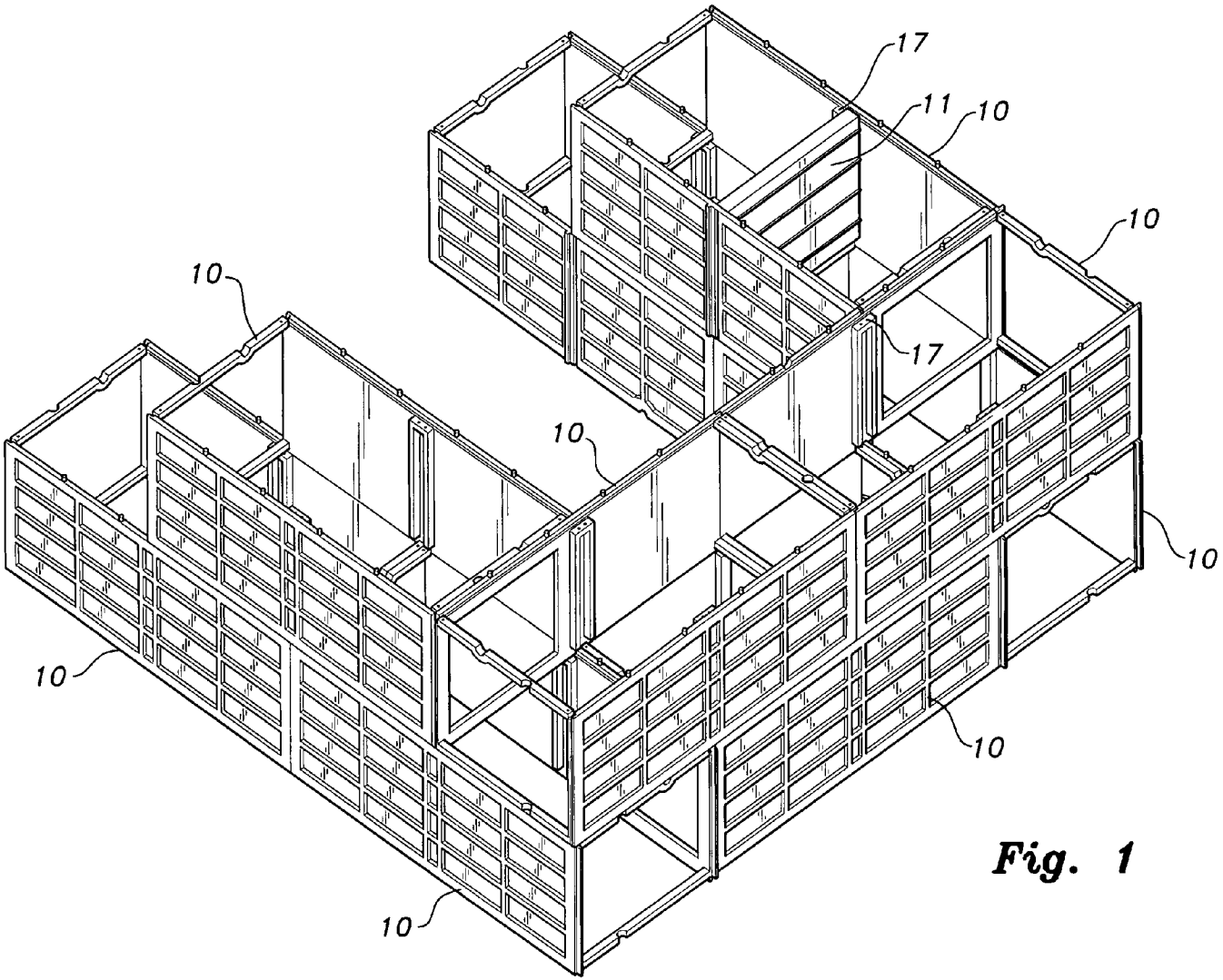
FIG. 1 is a perspective view of a structure formed from a plurality of modular construction blocks according to the present invention.

The present invention is directed towards a modular construction block 10 for forming structures such as earth retaining walls, for example. As will be described in greater detail below, a plurality of modular construction blocks 10 are provided for the formation of the desired structures, with each block being hollow so as to fill the structure with concrete. Rather than acting as a removable form for the construction of a concrete wall, for example, the blocks 10 may be left in place, forming part of the permanent structure. FIG. 1 illustrates an exemplary wall formed from a plurality of interlocking construction blocks 10.

Figure 2:
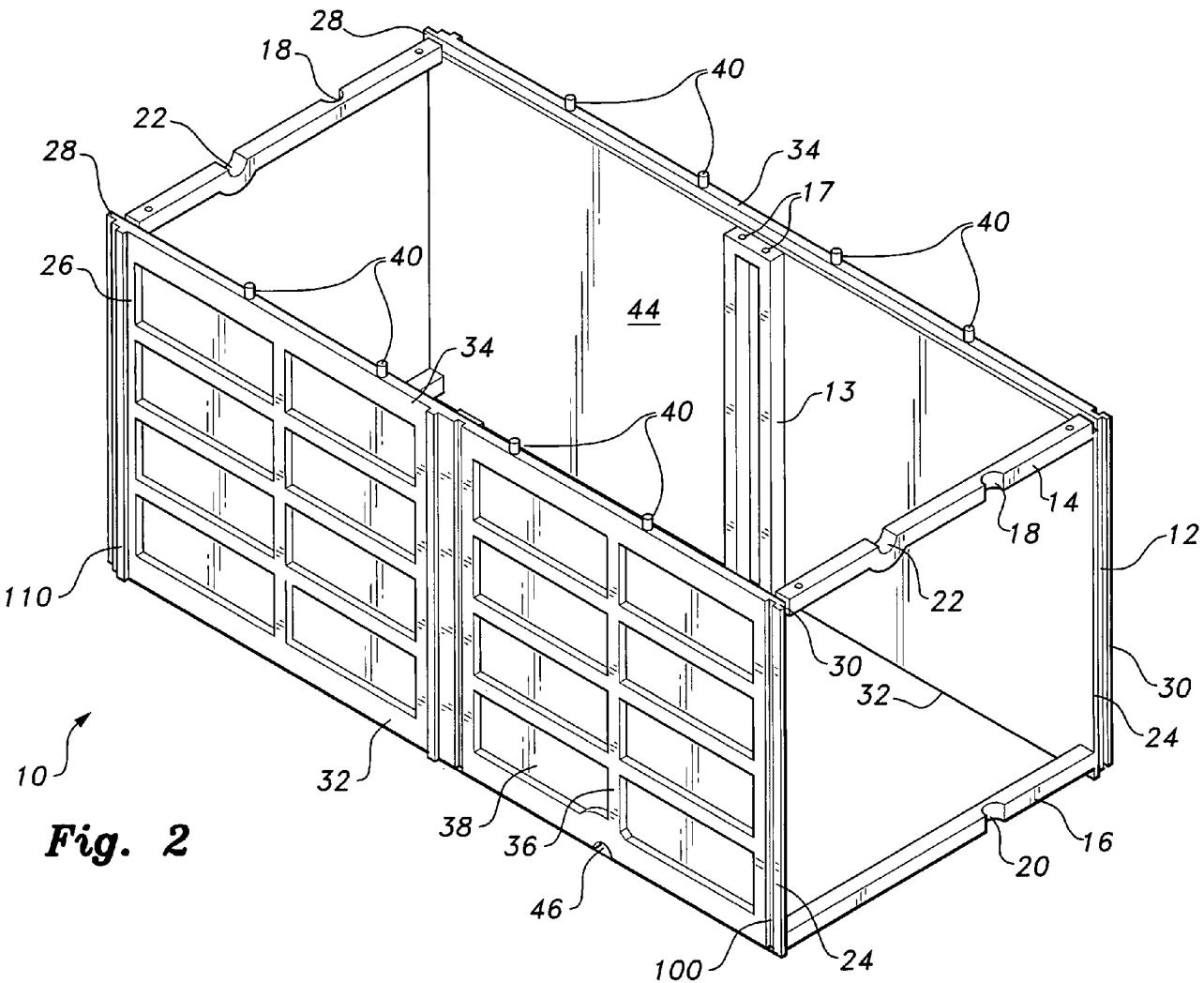
FIG. 2 is a rear perspective view of a modular construction block according to the present invention.

As best shown in FIG. 2, each modular construction block 10 preferably has a substantially rectangular cross-sectional contour. The block 10 is preferably formed from hard plastic or the like and includes a hollow, parallelepiped frame 12. Frame 12 is formed from a pair of upper longitudinal frame members 34, a pair of lower longitudinal frame members 32, a pair of upper lateral frame members 14, a pair of lower lateral frame members 16, and longitudinally opposed pairs of vertical frame members 24, 26, as shown. A pair of longitudinally extending walls 38, 44 are secured within the frame, as shown. Although the frames 12 of each block 10 may be dimensioned as needed, exemplary dimensions include a vertical height of approximately eight inches, a longitudinal length of approximately eighteen inches, and a lateral length of approximately nine inches. The plastic frame 12 may be formed through injection molding or any other suitable process for the formation of hard plastic structures.

Figure 4:
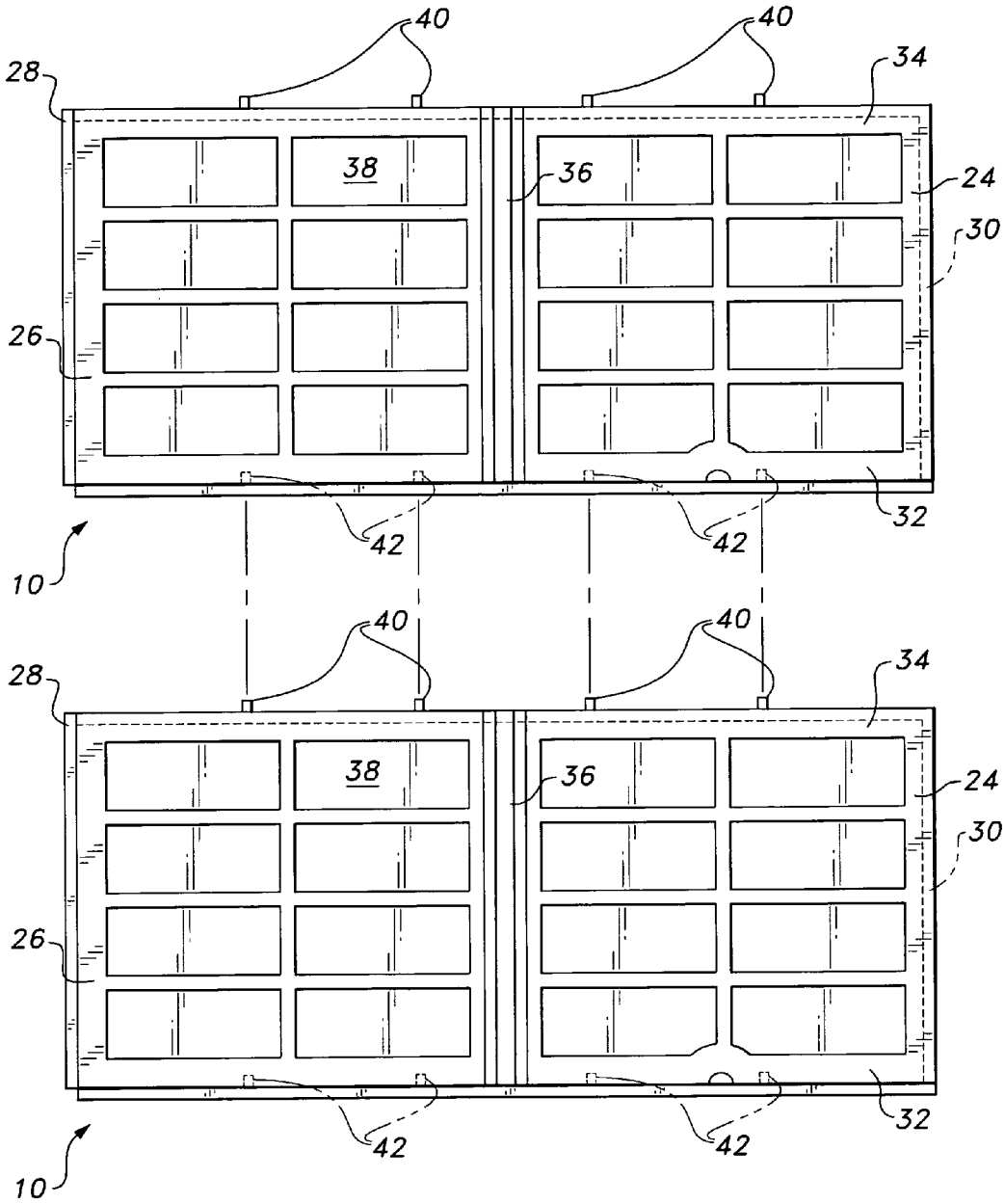
FIG. 4 is a side attachment view showing a pair of vertically adjacent modular construction blocks being secured together.

A plurality of projecting engaging elements 40 are formed on each upper longitudinal frame member 34. Though shown as having four such elements formed on each upper longitudinal frame member 34, it should be understood that any suitable number of projecting engaging elements 40 may be formed thereon. As best shown in FIG. 4, the plurality of projecting engaging elements 40 are received within a respective set of recesses 42 formed in the lower longitudinal frame members 32 of a vertically adjacent block 10. Thus, in order to form a structure such as that shown in FIG. 1, vertically adjacent blocks 10 are secured to one another through engagement of projecting engaging elements 40 within corresponding recesses 42 of the adjacent block. Preferably, the blocks are assembled in a staggered fashion. It should be understood that FIG. 4 is shown as having two vertically aligned blocks for the sake of simplicity. The locking of engaging members 40 within recesses 42 allows for proper alignment of the blocks, and aids in creating a proper seal between the blocks.

Figure 5:
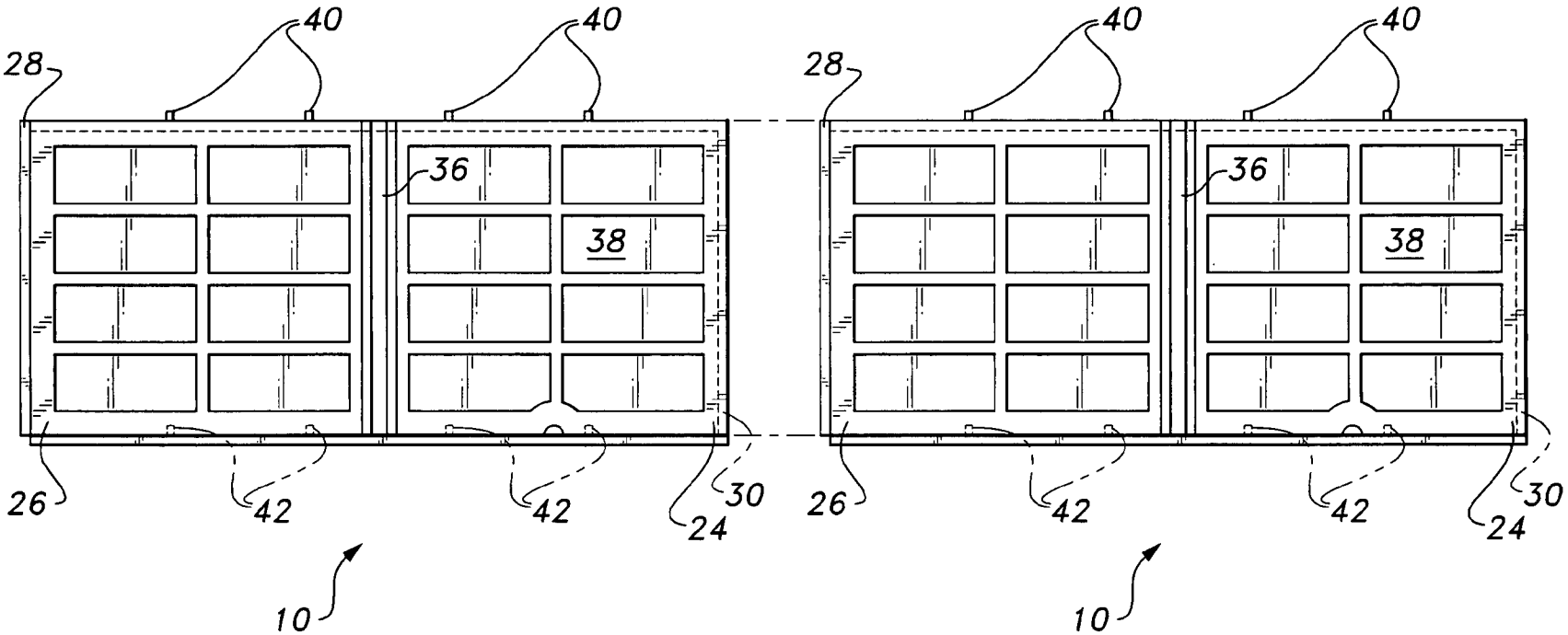
FIG. 5 is a side attachment view showing a pair of horizontally adjacent modular construction blocks being secured together.

Referring again to FIG. 2, each of the vertical frame members 26 (shown on the left in FIG. 2) has a vertically extending engaging bar 28 mounted thereon, as shown. As best shown in FIG. 5, horizontally adjacent blocks 10 are secured to one another through insertion of vertically extending engaging bars 28 within corresponding vertically extending recesses 30, formed within the vertical frame members 24 (shown on the right in FIGS. 2 and 5). Thus, in order to form a structure such as that shown in FIG. 1, vertically adjacent blocks 10 are secured to one another through engagement of projecting engaging elements 40 within corresponding recesses 42 of the vertically adjacent block, and horizontally adjacent blocks 10 are secured to one another through engagement of vertically extending engaging bars 28 within the vertically extending recesses 30 of the horizontally adjacent block 10. Exemplary dimensions for the vertically extending engaging bars 28 and the vertically extending recesses 30, based upon the exemplary dimensions given above for frame 12, are a vertical length of approximately eight inches, a longitudinal thickness of approximately ⅛ of an inch, and a lateral thickness of approximately ¼ of an inch.

As shown in FIG. 2, rear wall 38 may include reinforcing bars 36, though it should be understood that the configuration of bars 36 is shown for exemplary purposes only. In the front view of FIG. 3, a second configuration of reinforcing bars 48 is shown on the outer face of front wall 44. The configurations of reinforcing bars are dependent upon the particular needs and desires of the user. As shown in the Figures, two internal vertical rails or ribs 13 are preferably formed on the front and rear walls to allow for installation of a stop plate (or a "blocking plate") when necessary, as will be described in greater detail below.

Figure 8:
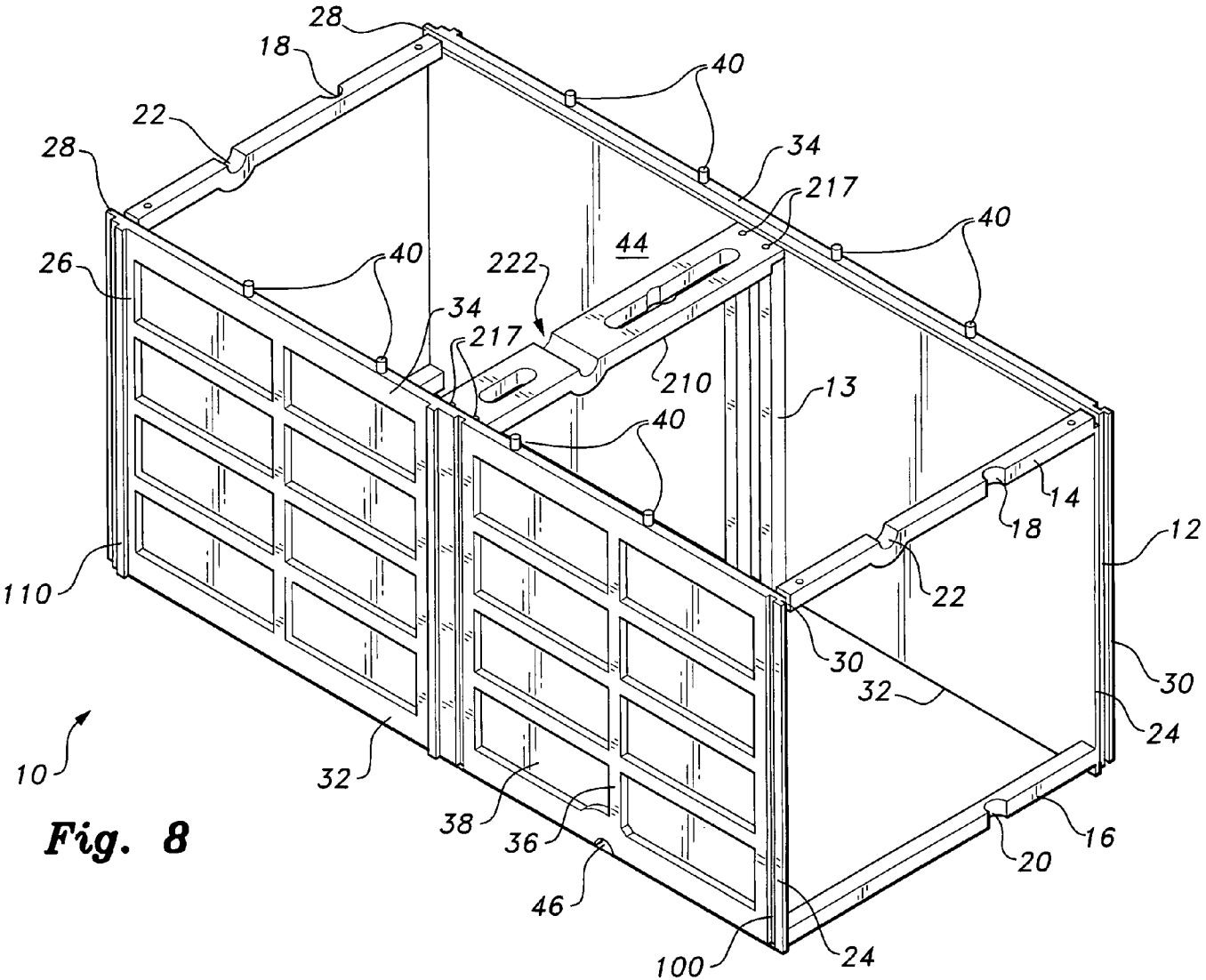
FIG. 8 is a rear perspective view of an alternative embodiment of the modular construction block according to the present invention.

Further, as shown in FIG. 8, at least one optional, or alternative, lateral cross-member 210 may be provided. As shown, the lateral cross-member 210 is positioned centrally, above rails 13 (to be described in greater detail below). Additional lateral cross-members 210 may be provided, positioned away from the lateral center line. A horizontally extending recess 222 is formed through the lateral cross-member 210, to match recesses 22 (to be described in detail below) of laterally extending members 14. Additionally, engaging recesses 17 of rails 13 (to be described in greater detail below) are replaced by corresponding recesses 217 formed in cross-member 210. The cross-member(s) 210 formed at the top end of each block 10 minimizes warping during the cooling process of manufacture, when the individual parts are demolded. This allows for a more efficient assembly process of the block 10, along with providing enhanced structural stability.

Figure 3:
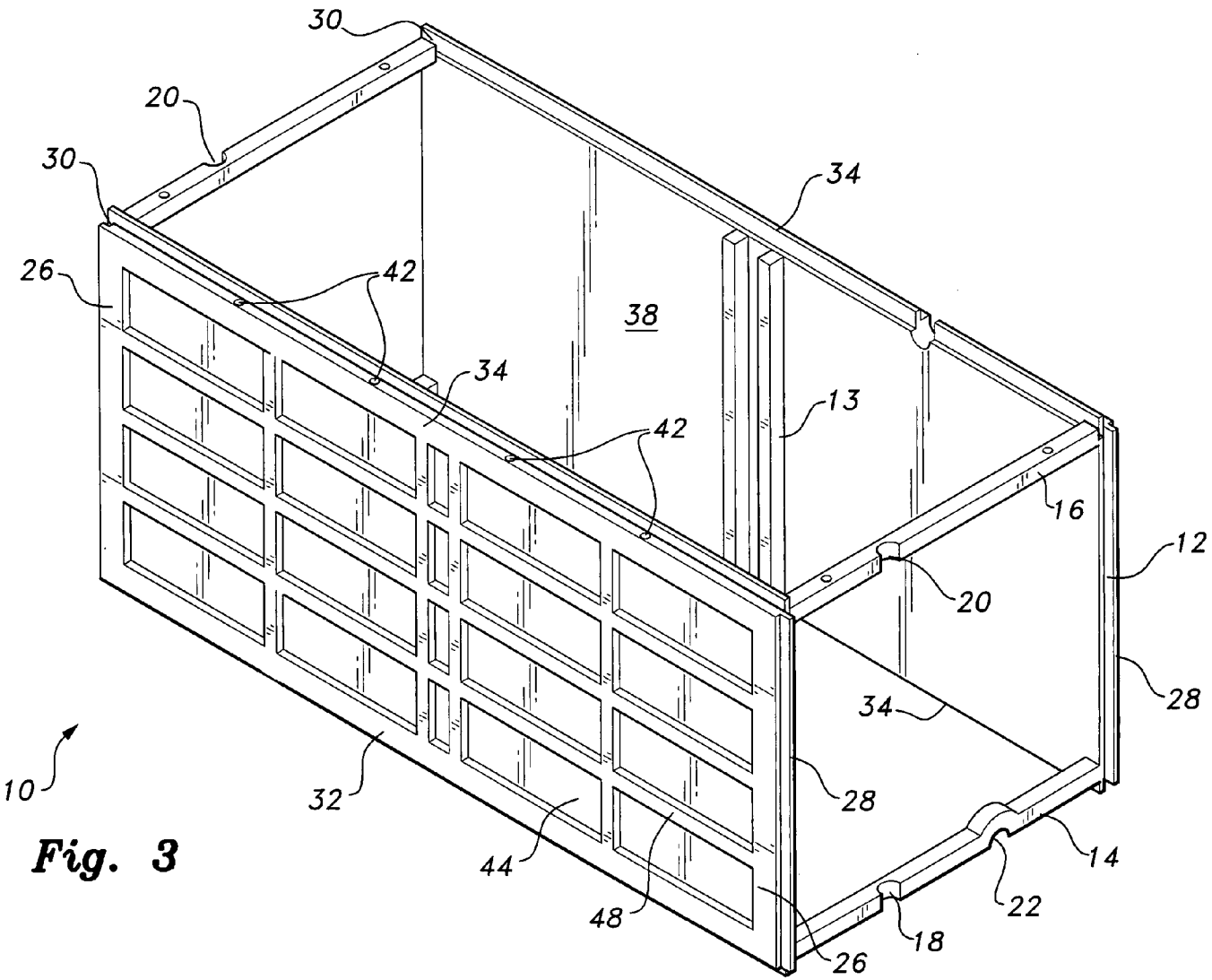
FIG. 3 is a front perspective view of a modular construction block according to the present invention.
Figure 6:
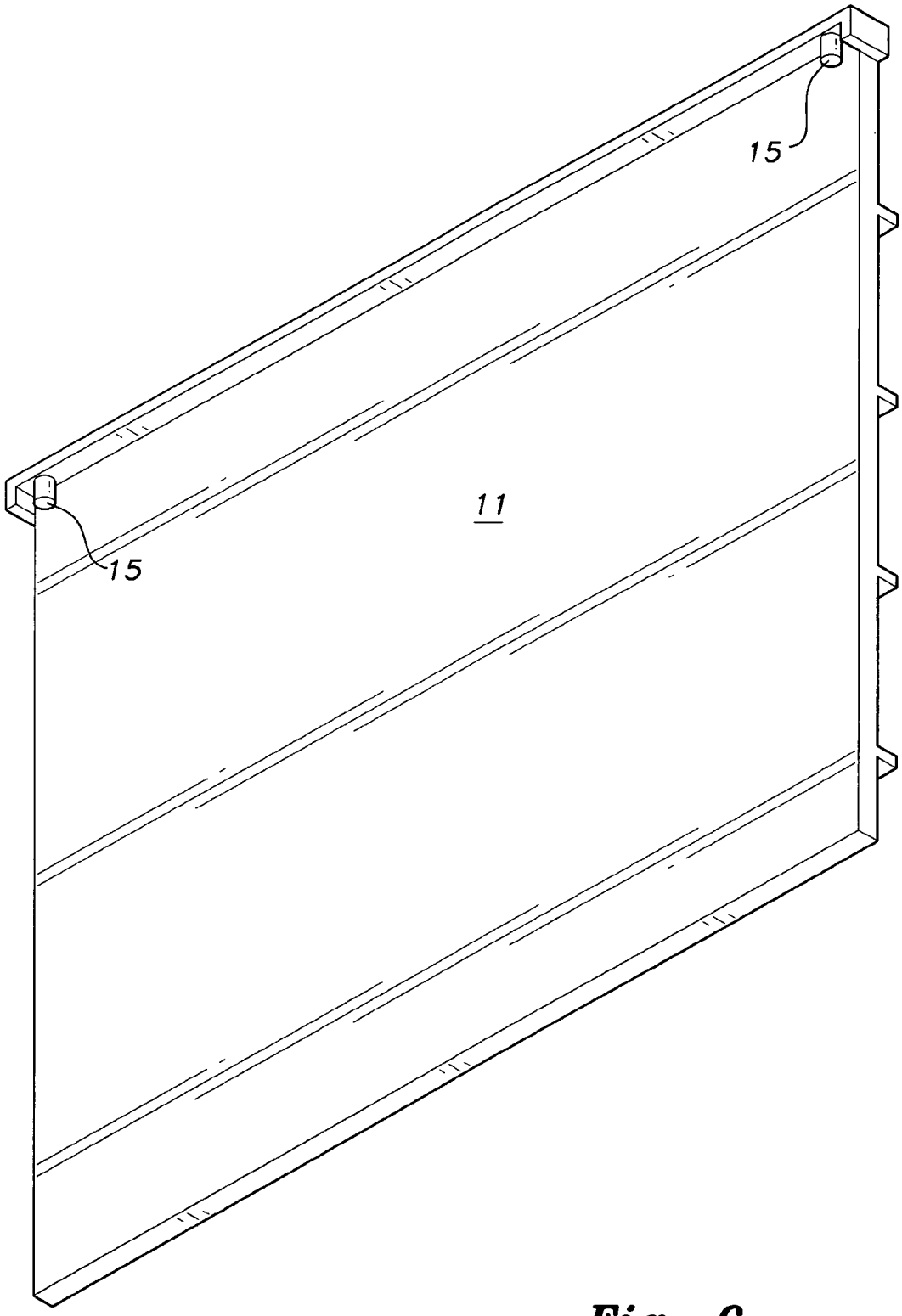
FIG. 6 is a perspective view of a stop plate of the modular construction block according to the present invention.

Since the blocks are preferably assembled in a staggered manner, as in FIG. 1, every other course will require a half block to finish a row. In FIG. 1, a stop plate 11 is shown inserted in one block 10 (in the upper, right-hand portion of the exemplary structure). As shown in FIGS. 2 and 3, opposed sets of rails 13 are mounted on the internal faces of walls 38, 44, for supporting and retaining stop plates 11. As shown in FIG. 6, stop plate 11 includes pins 15 mounted to the lower surface thereof, for engaging recess 17 (best shown in FIG. 2) formed in the upper surface of each pair of rails 13. Rather than manufacture half blocks, stop plates 11 are preferably employed at the middle of a full block 10 to accomplish the same effect, as shown in FIG. 1. The excess plastic can then be cut away after the concrete has cured. The pair of rails or ribs 13 are used on both the rear and front walls 38, 44 because the stop plate 11 must align with the actual end of the blocks 10 above and below. Each end of the main block 10 will accept the same stop plate 11, so that when a full block 10 is placed at the end of a wall assembly, it can be blocked to prevent the concrete from escaping the form.

Additionally, as shown in FIGS. 2 and 3, each adjacent pair of upper lateral frame members 14 and lower lateral frame members 16 has a vertically extending recess 18, 20 respectively formed therein, with the recesses 18, 20 facing outwardly. Additionally, each upper lateral frame member 14 has a horizontally extending recess 22 formed therein, with each recess 22 being open in the vertically upward direction. Similarly, each lower longitudinal frame member 32 has a laterally extending recess 46 formed therein, with each recess 46 being open in the vertically downward direction. When joined to adjacent blocks 10, these recesses form substantially circular openings for receiving rebar or other construction elements typically associated with the formation of concrete walls. Although the diameters of the recesses may be varied dependent upon the types of rebar to be inserted, exemplary dimensions for each circular opening include a diameter of approximately 9/16 of an inch to accommodate conventional ½ inch rebar used for "dead-man" type anchoring systems.

In use, a plurality of blocks 10 are joined together, locking together as described above in both the vertical and horizontal directions, in order to form a structure, such as the exemplary wall shown in FIG. 1. The frame 12 of each block 10 are hollow, so that after the wall structure is formed, including the addition of rebar or other structural elements, the interior of the wall may be filled with concrete. Once the concrete sets, the plastic blocks 10 and the interior concrete and other structural elements form the finished wall.

In addition to the basic blocks described above, specialized blocks for 90° corners may also be manufactured and utilized in a similar manner. Such blocks could be manufactured so that either the left, rear sidewall remains open, or the right, rear sidewall remains open. In both cases, members 28, as described above, are formed on the right, rear side of the rear wall, and corresponding recesses 30 are formed on the left, rear side of the rear wall to accommodate the 90° blocks. When the 90° corner is to be formed on the left end of a wall structure, the left rear panel will be open, and when the corner is to be made on the right, the right rear panel will be open. This allows the concrete to flow around the corner. A stop plate 11 may be used to block the end of the main block, either on the left or right as needed. As shown in FIG. 2, corresponding members and recesses 110, 100, respectively, (similar to members 28 and recesses 30) are formed on longitudinally opposed ends of the rear wall of each block, allowing for the 90° interconnection of the blocks (with corresponding members 28 and recesses 30 of the intersecting blocks). Similarly, as shown in FIG. 3, a longitudinally extending engaging bar or member is mounted on the upper end of each longitudinally extending wall for engaging a corresponding longitudinally extending recess formed in the lower edge of each longitudinally extending wall.

Figure 7:
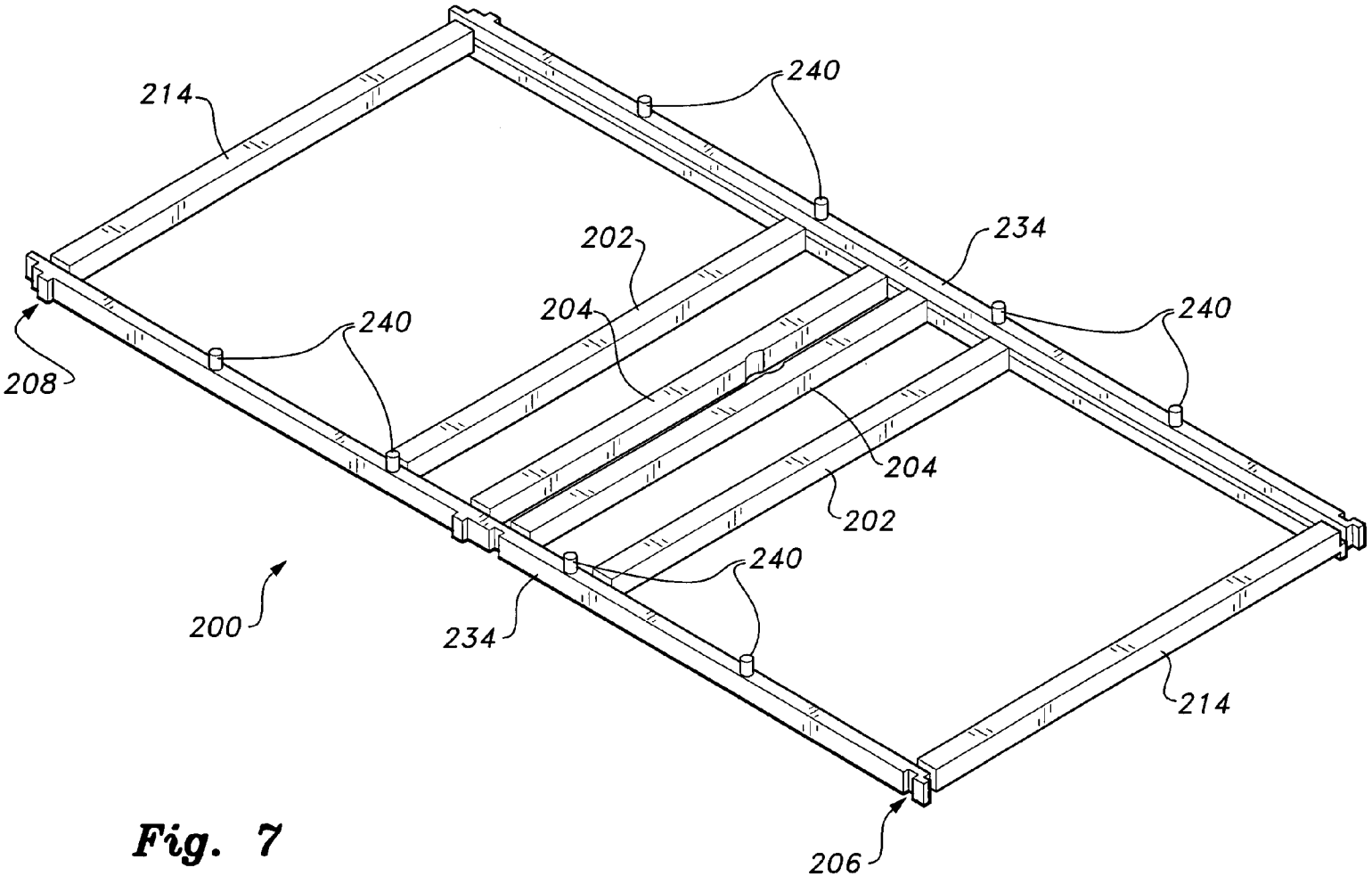
FIG. 7 is a perspective view of an alternative base of a modular construction block according to the present invention.

Additionally, one or more bases 200 may be provided. As shown in FIG. 7, base 200 resembles the upper horizontal frame of one of the modular blocks, including a pair of laterally extending members 214 and a pair of longitudinally extending members 234. Additional support struts 202 may be provided, along with a pair of laterally extending struts 204, adapted to engage the optional stop plate 11. The longitudinally extending members 234 have a plurality of projecting engaging elements 240 formed thereon, matching elements 40 and, similarly, projecting members 208 and recesses 206 are provided, corresponding to members and recesses 110, 100, respectively. Base 200 provides an initial, stable mount (and positioning member), and further provides lateral strength along the bottom of the wall as concrete is poured therein.

It is to be understood that the present invention is not limited to the embodiment described above, but encompasses any and all embodiments within the scope of the following claims.

I claim:

1. A modular construction block, comprising:

a hollow, one-piece frame having a pair of upper longitudinally extending members, a pair of lower longitudinally extending members, a pair of upper laterally extending members respectively secured to, and extending between, longitudinally opposed ends of the pair of upper longitudinally extending members, wherein each of the upper laterally, extending members has an upwardly facing, horizontally extending recess formed therein and being spaced from the opposed upper ends, a pair of lower laterally extending members respectively secured to, and extending between, longitudinally opposed ends of the pair of lower longitudinally extending members, and first and second pairs of vertically extending members respectively secured to, and extending between, vertically adjacent ends of the pairs of upper and lower longitudinally extending members, wherein each of the upper and lower laterally extending members has an outwardly facing, vertically extending recess respectively formed therein and being spaced from the opposed .upper and lower ends, respectively;

first and second walls secured to, and covering, laterally opposed ends of said hollow frame;

a plurality of projecting engaging elements being formed on upper surfaces of said pair of upper longitudinally extending members, each of the projecting elements being spaced from the pair of upper laterally extending members and the midpoint of each of the upper longitudinal frame members, a plurality of recesses being formed in lower surfaces of said pair of lower longitudinally extending members and being vertically aligned with a corresponding projecting element, whereby the plurality of projecting engaging elements are received within the plurality of recesses of a vertically adjacent one of said modular constructions blocks; and a pair of vertically extending engaging bars mounted to the first pair of vertically extending members and extending outwardly therefrom, a pair of vertically extending recesses being formed in the second pair of vertically extending members, whereby the pair of vertically extending engaging bars are received within the pair of vertically extending recesses of a horizontally adjacent one of said modular construction blocks, wherein an upper end, a lower end and a pair of longitudinally opposed ends of said hollow frame are each open.

2. The modular construction block as recited in claim 1, wherein each said lower longitudinally extending member has a lower horizontally extending recess formed therein, the lower horizontally extending recess facing downwardly.

3. The modular construction block as recited in claim 2, further comprising:

a substantially planar stop plate removably received within a substantially central portion of said hollow frame; and means for releasably securing the stop plate and orienting the stop plate such that the stop plate extends laterally and vertically with respect to the horizontal frame.

4. The modular construction block as recited in claim 3, wherein said means for releasably securing the stop plate and orienting the stop plate comprise first and second pairs of rails, each said pair of rails extending vertically and being positioned substantially centrally with respect to an adjacent pair of upper and lower longitudinally extending members.

5. A retaining wall, comprising:

a plurality of modular construction blocks, each said modular construction block comprising:

a hollow, one-piece frame having a pair of upper longitudinally extending members, a pair of lower longitudinally extending members, a pair of upper laterally extending members respectively secured to, and extending between, longitudinally opposed ends of the pair of upper longitudinally extending members, wherein each of the upper laterally extending members has an upwardly facing, horizontally extending recess formed therein and being spaced from the opposed upper ends, a pair of lower laterally extending members respectively secured to, and extending between, longitudinally opposed ends of the pair of lower longitudinally extending members, and first and second pairs of vertically extending members respectively secured to, and extending between, vertically adjacent ends of the pairs of upper and lower longitudinally extending members, wherein each of the upper and lower laterally extending members has an outwardly facing, vertically extending recess respectively formed therein and being spaced from the opposed upper and lower ends, respectively;

first and second walls secured to, and covering, laterally opposed ends of said hollow frame;

a plurality of projecting engaging elements being formed on upper surfaces of said pair of upper longitudinally extending members, each of the projecting elements being spaced from the pair of upper laterally extending members and the midpoint of each of the upper longitudinal frame members, a plurality of recesses being formed in lower surfaces of said pair of lower longitudinally extending members and being vertically aligned with a corresponding projecting element, whereby the plurality of projecting engaging elements are received within the plurality of recesses of a vertically adjacent one of said modular constructions blocks; and a pair of vertically extending engaging bars mounted to the first pair of vertically extending members and extending outwardly therefrom, a pair of vertically extending recesses being formed in the second pair of vertically extending members, whereby the pair of vertically extending engaging bars are received within the pair of vertically extending recesses of a horizontally adjacent one of said modular construction blocks, wherein an upper end, a lower end and a pair of longitudinally opposed ends of said hollow frame are each open.

6. The modular construction block as recited in claim 1, wherein the hollow frame is parallelepiped.

* * * * *